US006142772A

United States Patent [19]

Bai

[11] Patent Number: 6,142,772

[45] Date of Patent: Nov. 7, 2000

[54] MOVABLE TUNNEL KILN FOR MAKING CLAY PRODUCTS AND A SYSTEM WITH THE TUNNEL KILN

[76] Inventor: Fei Bai, Feng Village, Lingzhao Township, Changan County, Shanxi Province 710115, P.R., China

[21] Appl. No.: 09/242,138

[22] PCT Filed: Jul. 2, 1997

[86] PCT No.: PCT/CN97/00068

§ 371 Date: Jun. 1, 1999

§ 102(e) Date: Jun. 1, 1999

[87] PCT Pub. No.: WO98/05913

PCT Pub. Date: Feb. 12, 1998

[30] Foreign Application Priority Data

Aug. 2, 1996 [CN] China ..... 96118740

[51] Int. Cl.[7] ..... F27B 9/00

[52] U.S. Cl. ..... 432/120; 432/138; 432/137

[58] Field of Search ..... 432/137, 138, 432/120

[56] References Cited

U.S. PATENT DOCUMENTS

| | | | |
|---|---|---|---|
| 3,456,308 | 7/1969 | Nicoll, Jr. | 425/383 |
| 4,406,618 | 9/1983 | Maeyama | 432/138 |
| 4,580,973 | 4/1986 | Mansperger et al. | 432/194 |

*Primary Examiner*—Pamela Wilson
*Assistant Examiner*—Jiping Lu
*Attorney, Agent, or Firm*—Knobbe Martens Olson & Bear, LLP

[57] ABSTRACT

The invention relates to a movable tunnel kiln for clay product manufacture and a production process system employing a tunnel kiln. Provided a kiln bottom of the tunnel kiln is fixed and takes a circular shape, the kiln body is circular and movable, road wheels moving on a circular railway are installed on both sides of the kiln body. A circular raw material aging pit concentric with kiln bottom is installed at the site inside the circular kiln bottom, and a complete brickmaking equipment is installed at the central part of the site. An operation mode of stationary bricks stack with movable kiln body is adopted in the invention, which changes the conventional operation of loading and unloading for the brick, and a plurality of cars with auxiliary facilities are cancelled, thereby greatly reduces the kiln construction cost.

7 Claims, 6 Drawing Sheets

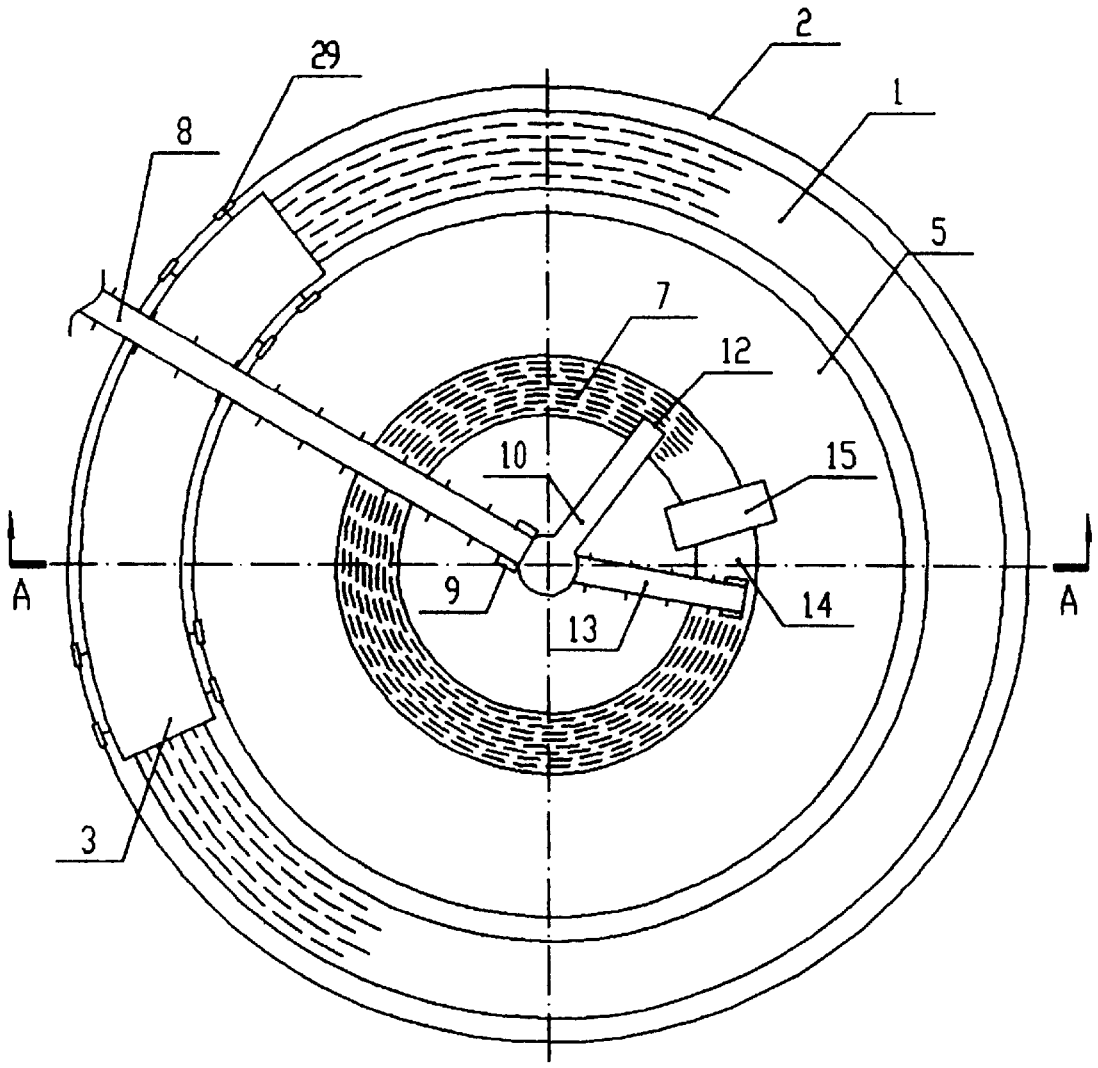
图 1

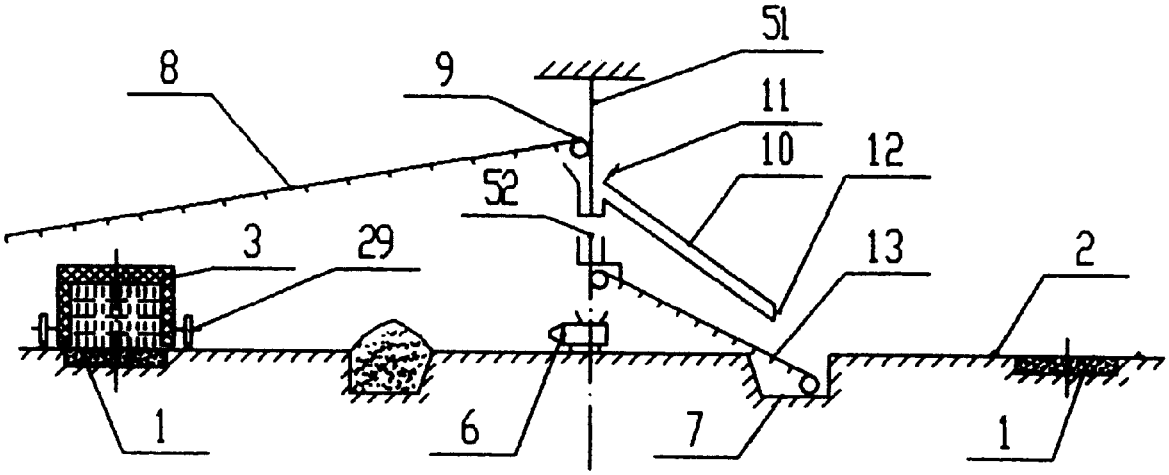
图 2

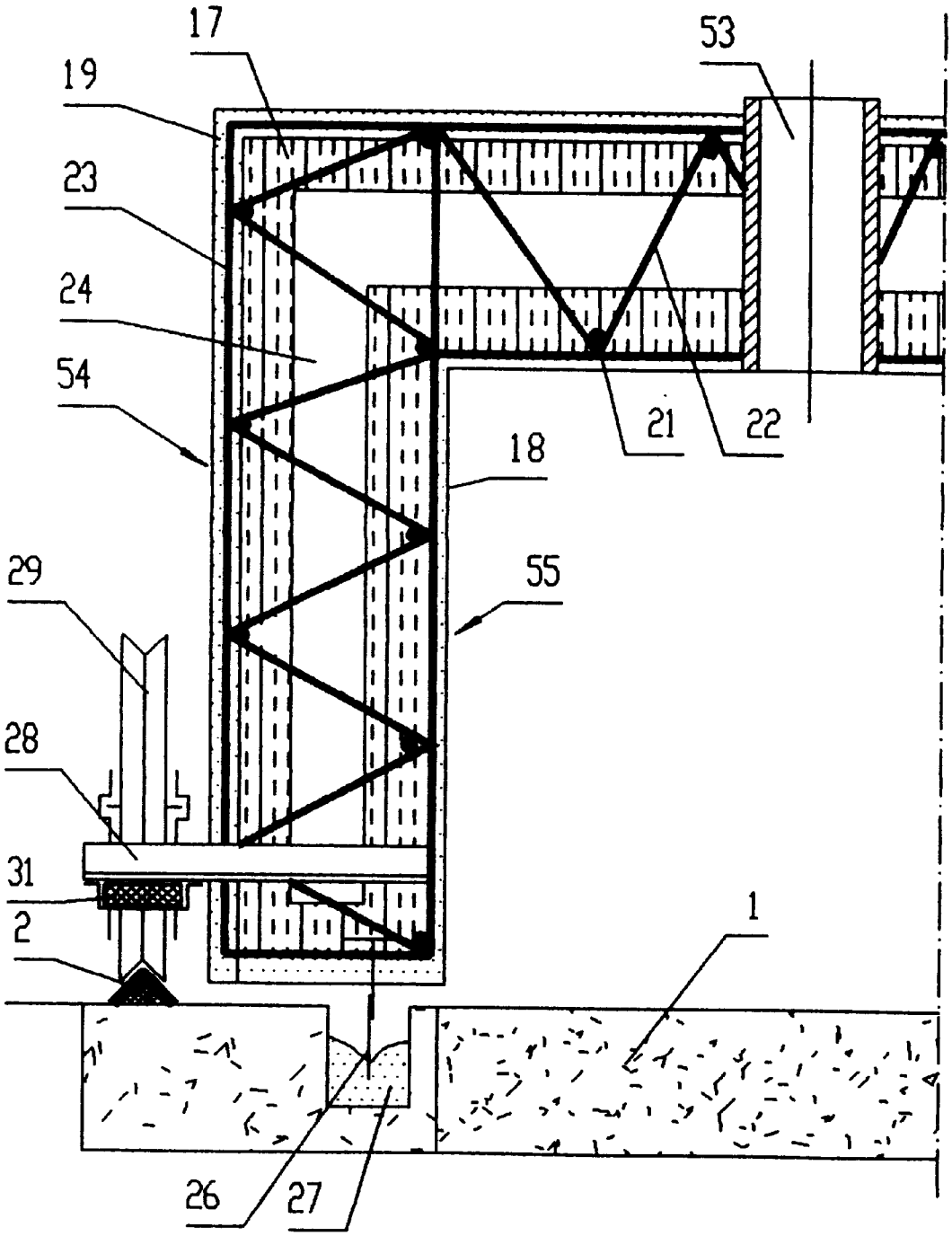
图 3

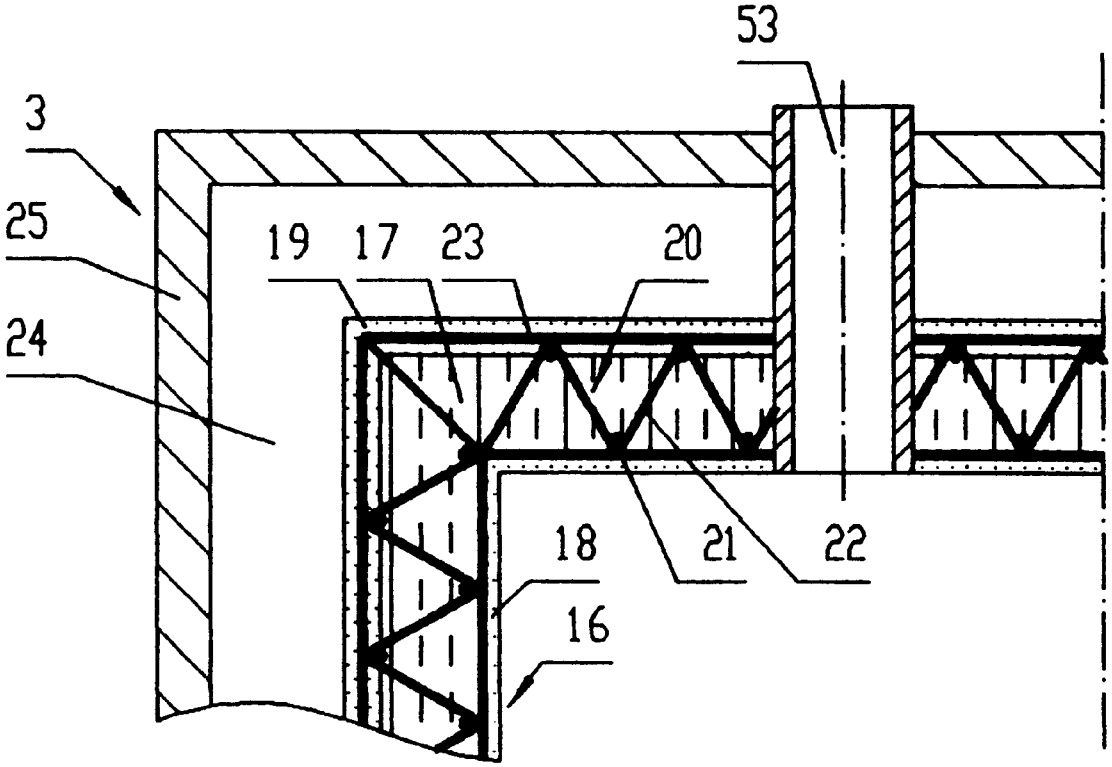
图 4
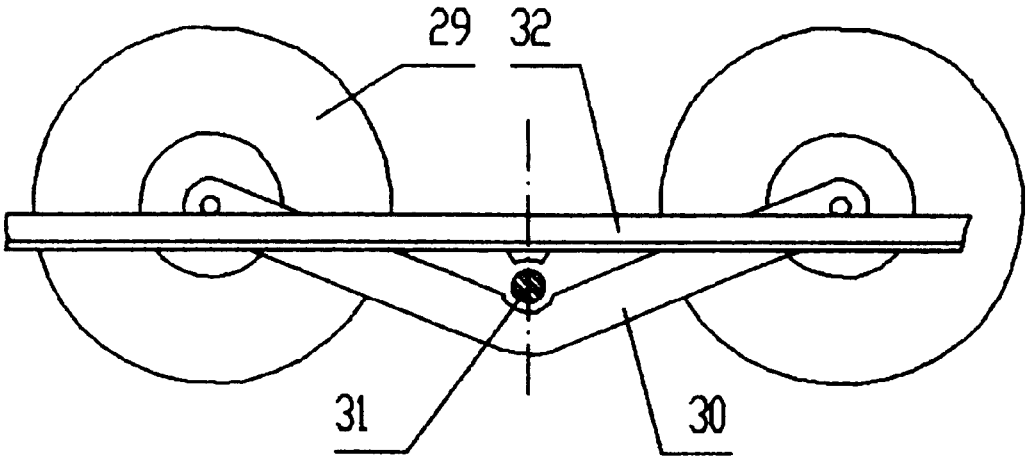
图 5

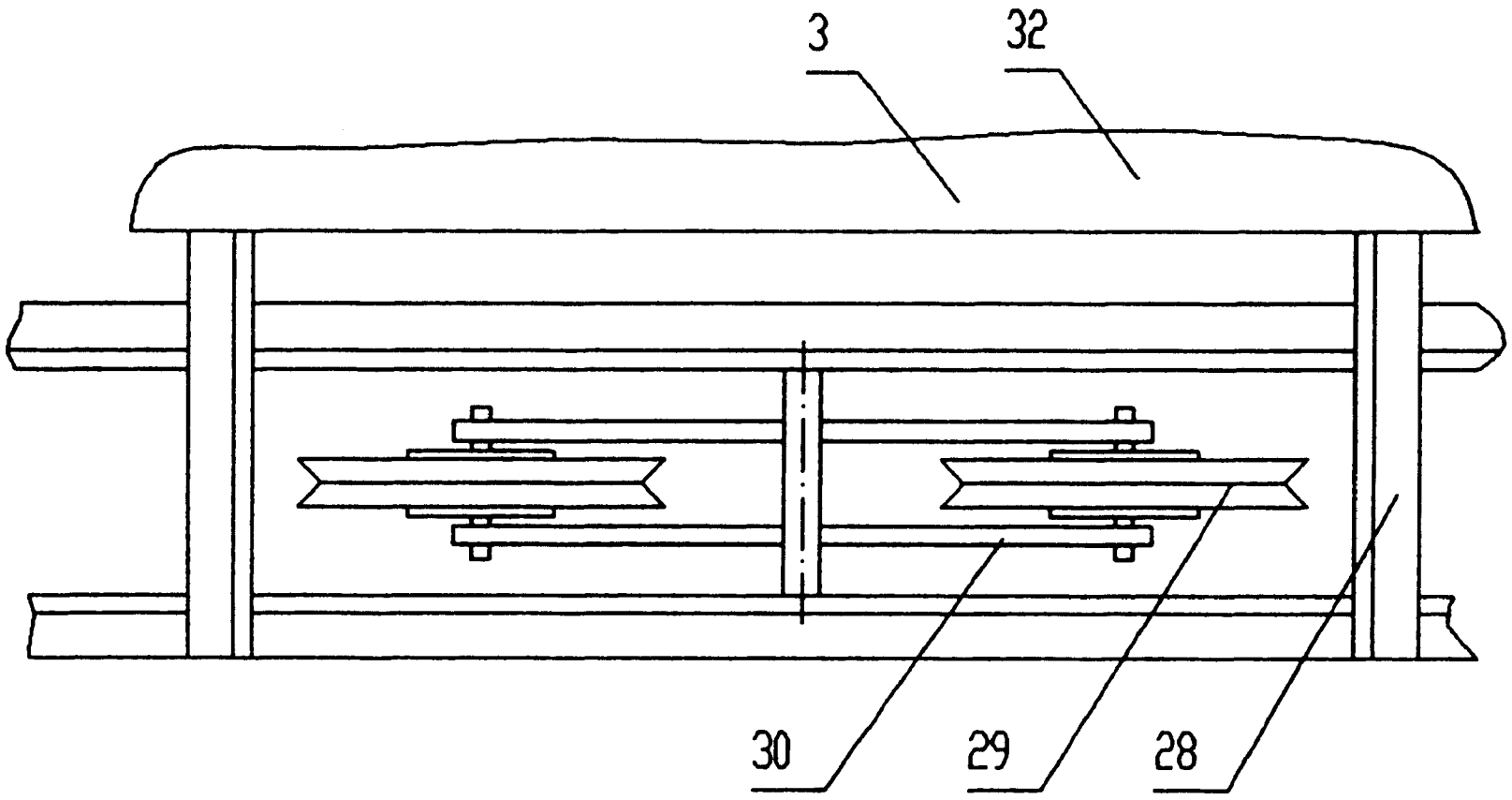
图 6

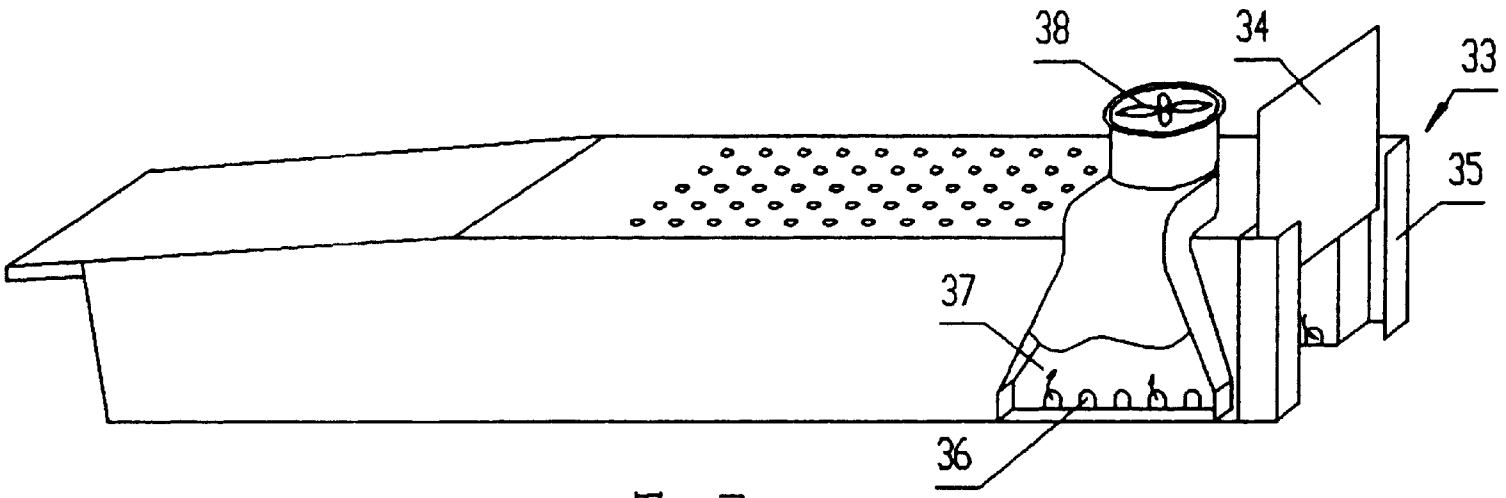
图 7
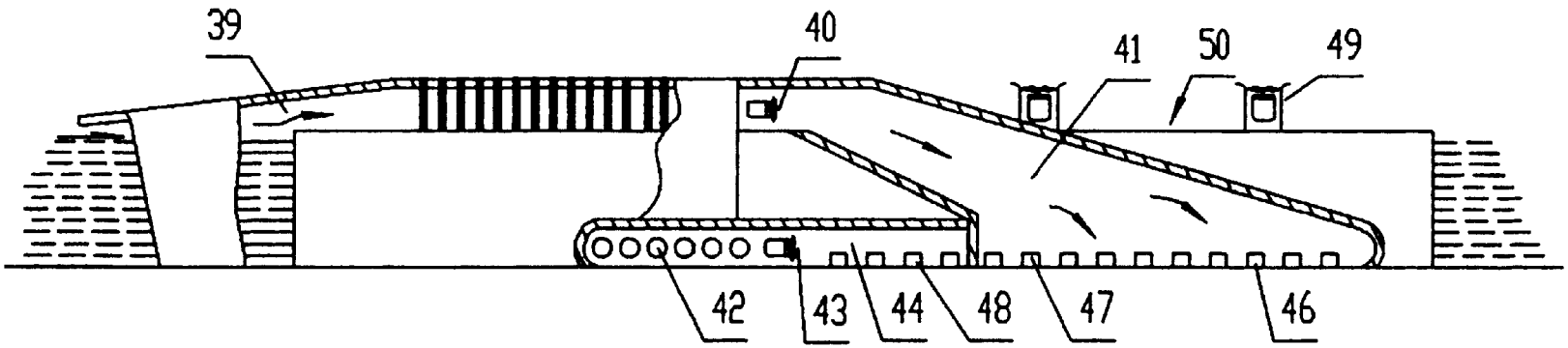
图 8

MOVABLE TUNNEL KILN FOR MAKING CLAY PRODUCTS AND A SYSTEM WITH THE TUNNEL KILN

FIELD OF THE INVENTION

The invention relates to the field of clay products manufacturing technology, is a type of movable tunnel kiln and manufacturing technological process system using the tunnel kiln.

BACKGROUND OF THE INVENTION

At present, main equipment for firing clay products like bricks and tiles etc are annular kilns and tunnel kilns. An annular kiln has lower heat efficiency, a bad working environment, heavy labor intensity and is in major part of manual operation. Therefore, besides some small brickfields which are employing annular kilns, most of the large and medium-sized brickfields adopt tunnel kilns. An existing tunnel kiln has a tunnel-typed kiln body, its bottom consists of a plurality of kiln cars, while the kiln cars with green bricks set on enter one end of the kiln body, pass through the kiln with four zones of preheating, firing, soaking, and cooling, come out from another end of the kiln body. Car pusher, transfer car and drafter etc should be provided. And a number of auxiliary railways should be paved for returning the cars to the kiln entry. Consequently existing tunnel kilns require pretty large investment, of which one third is for cars. In addition, since the cars has a higher daily maintenance cost for running under a high temperature environment, and air leakage on cars bottom results in quite an amount of heat loss.

SUMMARY OF THE INVENTION

The general object of the invention is aimed at above problem for existing kilns, to provide a process system of movable tunnel kiln with a higher heat efficiency and a lower construction cost, and manufacturing clay products using the tunnel kiln.

The main train of thought on realizing the object of the invention is to set the green bricks stationary under the movable kiln body, thus quite a lot of kiln cars might be saved. The specific solution is to provide a movable tunnel kilns comprising a tunnel kiln body and a kiln bottom, said kiln bottom is fixed and takes a circular shape, said kiln body is movable and circular arc, and is concentric with a circular kiln bottom, road wheels are furnished on both sides of the kiln body, they are placed on the circular railways on both sides of the kiln bottom, green bricks to be fired are piled upon a circular kiln bottom, while the kiln body moves along a circular railway, preheating, firing, soaking, and cooling the green bricks on the kiln bottom subsequently, of which the technological process is the same as existing tunnel kiln. After the fired bricks are removed from the kiln bottom, the green bricks are set again for next firing cycle.

In order to reduce conducting heat loss, lighten the kiln body weight, inner wall of the kiln body in the invention may be piled up with lightweight refractory fibre felt.

On clay products fabrication employing tunnel kiln of the invention, relevant process layout should be adopted, to fully utilize the site space inside a circular kiln, shorten the way of material flow, raise the production efficiency. Its specific process system is as follows:

Install a circular raw material ageing pit concentric with the kiln bottom in the round site space at the inside of aforesaid circular kiln bottom, and a complete brickmaking equipment is set up at the center of the above mentioned site space. Clay material, aged material and green bricks may be delivered with wagons, or transmitted with a conveyor.

On transmitting with a conveyor, may layout according to the following scheme: a clay material conveyor crossing above the kiln is installed between the outside site and inside round site space of kiln bottom, an exit of the clay material conveyor is located at the center of aforesaid inside site space of the kiln bottom, a raw material conveyor, which leads to aforesaid ageing pit and perform circular motion along the ageing pit is installed under the clay material conveyor. An ageing material conveyor which performs circular motion along the ageing pit is installed between the ageing pit and the brickmaking equipment. A movable trestle crosses above the ageing pit. Clay material coming from outside of kiln bottom enter the ageing pit by aforesaid clay material conveyor, then is aged and delivered to the brickmaking equipment at the center of the site with an aged material conveyor, green bricks are delivered to be stacked via a trestle at the kiln bottom preparing for next firing.

Ageing pit of the invention is designed to be circular, a conveyor moving along the ageing pit and a clay material conveyor are provided, on one end the aged material may be taken out successively along the circular ageing pit and new clay raw material may be supplied, enabling the ageing treatment to be performed in continuous circulations on the other end the site space may also be fully utilized. Above mentioned conveyor exit is the feeding end for ageing pit, and the entry for ageing material conveyor is the exit of ageing pit.

Because the operation mode of stationary green bricks stack and a movable kiln body moving along a circular railway is employed in present invention, so that conventional loading and unloading operation, a plurality of kiln cars and auxiliary devices for existing tunnel kilns are canceled, which not only greatly reduces kiln construction and maintenance costs, but also saves labor, Improves working conditions, and is suitable for mechanical operation. Since the kiln cars and auxiliary facilities have been cancelled, therefore not only greatly reduce the fault rate but also eliminate heat loss resulted from air leakage on the kiln cars bottom in existing tunnel kiln, and heat efficiency will be raised. Moreover, since the green bricks stack are stationary in the firing process, therefore the damage ratio is lower. The manufacturing process system matching with tunnel kilns of present invention not only shorts the material flow process, but also effectively utilizes the site space, thereby raises the over all production efficiency.

BRIEF DESCRIPTION OF THE DRAWINGS

By referring to the accompanying drawing, as follows the foregoing and important objects of the present invention shall be described in detail.

FIG. 1 is a is a schematic diagram of overall process system in present invention.

FIG. 2 is a sectional view taken along line A—A in FIG. 1.

FIG. 3 is a structural diagram of a kiln wall in present invention.

FIG. 4 is another structural diagram of a kiln wall in present invention.

FIG. 5 is a structural diagram of a road wheel in present invention.

FIG. 6 is a top view of FIG. 5.

FIG. 7 is a sketch of the first example of a kiln wall in present invention.

FIG. 8 is a exploded view of the second example of a kiln wall in present invention.

DETAILED DESCRIPTION OF EMBODIMENTS OF THE INVENTION

As shown in FIG. 1, FIG. 2, kiln bottom 1 is circular, paved by refractory plates. A circular railway 2 with a triangular cross section is installed between inside and outside of the kiln bottom. Kiln body 3 takes the shape of a circular arc. The road wheel 29 of which are moving on a railway in both sides, therefore kiln body 3 is movable along railway 2. In order to fully utilize the site space surrounded by the inside of kiln bottom 1, the brickmaking equipment 6 and its auxiliary facilities etc are installed in the central area of site space, a circular ageing pit 7 is set upon the periphery of the central area, and the ageing pit is concentric with kiln bottom 1. Productive process of clay products is that firstly, the clay material should be aged, then delivered to the brickmaking equipment for green bricks production, after the green bricks are dried they are send to the kiln for firing. Since the kiln bottom of tunnel kilns is a sealed circular, therefore transport devices are required between clay material and ageing pit, and among ageing pit, the brickmaking equipment and tunnel kiln. To this end, a fixed clay material conveyor 8 is erected between the inside and outside of kiln bottom 1 crossing above the kiln, and its exit 9 is located at the center of site space 5. A conveyor 10 leading to ageing pit 7 is installed under conveyor 8, and feeding bin 11 of conveyor 10 is directed to the exit 9 of conveyor 8. Therefore, clay material can fall into ageing pit 7 via conveyor 8 and 10.

Exit 12 of conveyor 10 is a free end, its feeding end (i.e. bin 11) is articulated on pivot 51, so that the conveyor 10 may revolve around pivot 51, supplying raw material for the vacant zone of circular ageing pit. An aged material conveyor 13 is also installed between ageing pit 7 and brickmaking equipment 6, its exit is articulated on another central pivot 52, therefore the feeding end of aged material conveyor 13 is also movable along the ageing pit to take out aged material successively and deliver to the brickmaking equipment. Movable trestle 15 acrosses a vacant zone 14 of ageing pit between conveyor 10 and conveyor 13, to serve as green bricks transport device between the kiln bottom.

As shown in FIG. 3, FIG. 4, inner wall of kiln body 16 consists of refractory fibre felted laminate 17 mounted on frame 20, fireproof coating laminate 18 located on inside face of refractory fibre felted laminate and the cement plaster cladding material 19 located on outside face of the refractory fibre felted laminate. In which frame 20 consists of a longitudinal lacing wire 21 passing through refractory fibre felted laminate, a zigzag lateral lacing wire 22 connected with longitudinal lacing wire 21 and an outer layer steel wire gauze 23. On fabrication, refractory fibre felt (one or several laminates) and zigzag lateral lacing wire 22 are stacked in separation, then pass through the refractory fibre felt and lateral lacing wire with longitudinal lacing wire 21, and they are firmly clamped by screw bolts to form a wall. Coating laminate 18 is fabricated as follows: first squeezes the refractory mud into the surface layer of refractory fibre felt by a high pressure mud pump to form a fully squeezed laminate with a definite thickness, then coats a laminate of refractory mud to enhance the air tightness of inner wall. Since above kiln wall structure has been adopted, therefore the kiln body may be built in section in a factory, then splice a kiln body with the required length on site according to demand. The numerals in the diagram are: 53—coal hole, 24—sandwich space, serving as a heat transfer channel or flue channel, 25—outer wall, 26—sand seal plate, 27—sand seal trough.

A single layer inner wall structure is shown in FIG. 4, sandwich space 24 is located between outer and inner walls. FIG. 3 illustrates another structure form of skin wall, in which both the outer wall 54 and inner wall 55 adopt the inner wall structure form of FIG. 3, other structure are the same as FIG. 4.

Outrigger 28 installed with road wheel 29 is mounted on side of above kiln body, moreover it is fastened on frame 20 of outer and inner walls. Since the kiln body is longer, and moves under thermal condition, if the road wheels are rigidly connected with the kiln body, thus when a rail position deviates, or a foreign matter exists on the rails, or kiln body deformation etc occurred, derailing of road wheels may take place. In order to avoid such a condition, wheel carriers of the road wheels are flexibly connected with the kiln body. One of the specific examples is shown in FIG. 3, FIG. 5, FIG. 6. Every two road wheels 29 constitute a group, which is mounted on wheel carrier 30, a rubber rod 31 is installed at the center of wheel carrier, longitudinal part 32 of kiln body outrigger 28 is placed on the rubber rod, i.e, weight of the kiln body is supported by the wheel carriers of road wheels. In this way, two road wheel in each group may swing up and down with the rubber rod as a pivot point, moreover the rubber rod may perform flexibly bending on forcing, not only avoid derailing, but also realize buffering.

In the second setting and firing process, tunnel kiln chamber is generally divided into four zones of preheating, firing, soaking, and cooling. Kiln chamber layout of second setting and firing tunnel kiln in present invention is also the same. FIG. 7 is a simple schematic of second setting and firing tunnel kiln in present invention. A kiln door riser 33 is installed at the feeding end of the kiln, it consists of flash board 34 and flash board guide way 35. Flue holes 36 inter link with exhaust fan 38 on the kiln roof via flue channel 37 in the kiln to exhaust the flue gas in kiln.

FIG. 8 shows a structure of once-setting-firing tunnel kiln. It is the same as existing tunnel kiln. The kiln body is elongated, and a drying zone 50 is added. Air heat transfer channel 39 of the kiln in this embodiment is inter linked with the chamber of low, medium temperature drying zone of the kiln via exhaust fan 40 and inner wall channel 41 of kiln drying zone. Chamber flue holes 42 of kiln preheating zone are interlinked with a chamber of high temperature drying zone via another exhaust fan 43 and another inner kiln channel 44, i.e. air in lower temperature coming from above air heat transfer channel 39 enters the low, medium temperature drying zone. Smoke gas in higher temperature coming from preheating zone enters the high temperature drying zone, drys the green bricks gradually from low temperature to high temperature, thereby not only ensures drying quality, but also avoids cracking or deformation of green bricks. Numerals in the diagram are: 46—air entry of low temperature drying zone, 47—air entry of medium temperature drying zone, 48—air entry of high temperature drying zone, 49—exhaust fan of the kiln roof.

What is claimed is:

1. A tunnel kiln comprising:

a circular kiln bottom;

a pair of circular railways installed on both sides of the circular kiln bottom;

a movable tunnel kiln body;

road wheels connected to the movable kiln body, the road wheels being rotatably engaged with the pair of railways so that the movable tunnel kiln body can move along the circular railways;

a circular raw material aging pit concentric with the kiln bottom inside a round site space at the inside of the circular kiln bottom upon the periphery of the central area of the round site space; and complete brickmaking equipment at a center of said round site space.

2. A tunnel kiln as defined in claim 1, wherein an inner wall of the kiln body is piled up with lightweight refractory fiber felted laminates.

3. A tunnel kiln as defined in claim 2, wherein an inner kiln wall of the movable tunnel kiln body comprises:

a frame comprising a steel wire gauze, a longitudinal lacing wire, and a zigzag lateral lacing wire connected with longitudinal lacing wire; a refractory fiber felted laminate mounted on the frame such that the longitudinal lacing wire and the zigzag lateral lacing wire pass through the refractory fiber felted laminate, the refractory fiber felted laminate being formed on one side of the steel wire gauze;

a fire-proof coating laminate formed on the refractory fiber felted laminate; and a cement plaster cladding material laminate on the other side of the steel wire gauze.

4. A tunnel kiln as defined in claim 3, wherein the road wheels are connected to the kiln body via a wheel carrier which is detachably installed to the kiln body.

5. A tunnel kiln as defined in claim 4, wherein two road wheels are mounted on the wheel carrier and a rubber rod is installed on the center of the wheel carrier, and wherein an outrigger part of the kiln body outrigger is placed on rubber rod.

6. A tunnel kiln as defined in claim 10, further comprising:

a clay material conveyor installed between the inside and the outside of the kiln bottom crossing over the kiln body, the clay material conveyor conveying clay material between the round site space defined by the circular kiln bottom and an outside of the circular kiln bottom, an exit of the conveyor being located at a bin above the center of the round site space, a raw material conveyor installed under the clay material conveyor and at the center of the round site space between the exit of conveyor and the aging pit at the periphery of the central area of the round site space to receive the clay material exiting from the bin above the center of the round site space and transferring it to the aging pit upon the periphery of the central area of the round site space, an aging-pit end of the raw material conveyor being circularly movable along the aging pit;

an aged material conveyor installed between the aging pit and the brickmaking equipment at the center of the round site space to transfer aged material from the aging pit to the brickmaking equipment, an aging-pit end of the aged material conveyor being circularly movable along the aging pit; and a movable trestle installed above the aging pit, the trestle crossing beyond aging pit.

7. A tunnel kiln as defined in claim 1, wherein an air heat transfer channel of the kiln body leads to a first exhaust fan which leads to a first inner wall channel of the drying zone in the kiln body while chamber flue holes of a preheating zone in the kiln body lead to a second exhaust fan which leads to a second inner channel of the kiln body such that air of lower temperature coming from said air heat transfer channel of the kiln body enters through said first exhaust fan and on into said first inner wall channel of the drying zone and said preheating zone provides smoke in higher temperature which enters said second inner channel of the kiln body through said second exhaust fan.

* * * * *